United States Patent [19]

Yoshino

[11] Patent Number: 4,480,905

[45] Date of Patent: Nov. 6, 1984

[54] CLEANING AND DEVELOPING UNIT

[75] Inventor: Masaki Yoshino, Kanagawa, Japan

[73] Assignee: Fuji Xerox Co., Ltd., Tokyo, Japan

[21] Appl. No.: 417,290

[22] Filed: Sep. 13, 1982

[30] Foreign Application Priority Data

Sep. 16, 1981 [JP] Japan ..... 56-144784

[51] Int. Cl.[3] ..... G03G 15/08

[52] U.S. Cl. ..... 355/3 DD; 355/14 D; 355/15; 118/651

[58] Field of Search ..... 355/15, 3 DD, 14 D; 118/656, 651, 653, 661; 430/125, 120, 122

[56] References Cited

U.S. PATENT DOCUMENTS

| | | | |
|---|---|---|---|
| 4,013,041 | 3/1977 | Armstrong et al. | 118/656 |
| 4,264,185 | 4/1981 | Ohta | 355/3 DD X |
| 4,351,604 | 9/1982 | Karasawa et al. | 355/3 DD X |
| 4,361,397 | 11/1982 | Katakura et al. | 355/3 DD X |

*Primary Examiner*—A. C. Prescott

*Attorney, Agent, or Firm*—Sughrue, Mion, Zinn, Macpeak, and Seas

[57] ABSTRACT

A combination cleaning/developing unit for a copier includes a partition or barrier between the side of a first developing roll and the side of the remaining developing rolls, and toner is supplied only to the side of the remaining rolls, so that the first roll acts primarily as a cleaning roll as the toner content of the developing agent thereon is maintained at a low level.

8 Claims, 3 Drawing Figures

CLEANING AND DEVELOPING UNIT

BACKGROUND OF THE INVENTION

This invention relates to electrophotography devices, and more particularly to a cleaning and developing unit of a printing apparatus utilizing the principles of electrophotography, namely, an electronic printing apparatus.

Printing according to an electronic photographic system has been well known in the art. For instance, a xerographic printing system disclosed by U.S. Pat. No. 2,579,047 and an electronic printing apparatus disclosed by Japanese Patent Application Publication No. 1554/1968 are well known. In this prior art, a toner image is formed on a photo-conductive plate according to an electrostatic photographic method and is then fixed, so that a non-photo-sensitive insulating pattern, namely, a printing master, is formed on the photo-conductive plate. In succession, the printing master is uniformly charged and uniformly exposed to light, whereby the charges remain on only that image region which is not photo-sensitive, while the charges are removed from the photo-sensitive region. Therefore, by applying charged toner to the plate, which has been partially charged, a toner image is formed thereon. The toner image is then transferred onto a suitable image support. The above-described operation is repeatedly carried out to obtain prints.

More specifically, the aforementioned Japanese Patent Application No. 1554/1968 discloses an apparatus as shown in FIG. 1. In FIG. 1, reference numeral 1 designates a rotary drum having pawls on its cylindrical wall, to hold a photo-sensitive sheet 10. Provided around the drum 1 are a cleaning unit 8, a charging unit 4, a uniform exposure lamp 13, a developing unit 5, a transferring corotron 6 and an infrared fixing unit 7 for fixing a toner image on the photo-sensitive sheet 10.

The printing master is formed as follows. A photo-sensitive sheet 10, after being wound on the drum 1, is charged by the charging unit 4. The image of an original on a platen 3 illuminated by lamp 14 is projected onto the photo-sensitive sheet 10 through a projecting lens 2, so that a electrostatic latent image is formed therein. The latent image is developed by the developing unit 5, and the toner image is fixed on the photo-sensitive sheet 10 by the infrared fixing unit 7. Thus, a printing master is formed.

The method of obtaining a number of copies from the printing master thus formed by electrostatic printing is as follows: The printing master having the toner image on the photo-sensitive sheet is charged by the charging unit 4 and is then uniformly exposed to light with the overall exposure lamp 13. The charges on the photo-sensitive sheet 10, which is uniformly charged, are selectively discharged by the overall exposure, with the exception of those on the toner image region which is not photo-sensitive or photo-conductive. Thus, a printing master having charges on the toner-image region only is formed. The printing master thus formed is then developed by the developing unit 5. A transfer sheet 11 is delivered to the transfer section in synchronization with the rotation of the drum 1. The toner-image on the printing master is transferred onto the transfer sheet by the corotron 6 and then the image thus transferred is fixed by a fixing unit 9. Thereafter, the sheet is passed into exit tray. The toner remaining on the transfering master after printing is removed by the cleaning unit 8, to complete one printing cycle. The printing cycle as described above is repeatedly carried out as many times as the required number of copies.

The electrostatic printing apparatus as described above provides a number of copies. Therefore, a large quantity of used toner is accumulated in the cleaning unit 8, and accordingly inspection and maintenance of the cleaning unit is essential, i.e., it is necessary to frequently remove the toner from the cleaning unit. In order to solve this problem, a method is known in which a cleaning function is assigned to the developing unit 5, to thereby eliminate the cleaning unit. In the case where such a combination cleaning and developing unit is used, in order to obtain one copy, a method is used in which the drum is caused to make two revolutions to alternatively carry out developing and cleaning. Alternatively, a method is employed in which a bias voltage applied to the developing unit during the developing process is made different from that applied during cleaning.

However, the method is disadvantageous in that the apparatus for practicing the method is intricate, and that, as the drum must make two revolution for one copy, the method is not suitable for high speed copying.

SUMMARY OF THE INVENTION

One object of this invention is to provide a developing unit which can clean a printing master by removing residual toner thereon, and another object of the invention is to provide a printing apparatus in which a separate cleaning unit is eliminated and wherein one copy can be obtained by one revolution of the drum.

According to the invention, in an electronic printing method in which a printing master is prepared by fixing a toner image on a photo-conductive plate, and the toner image on the printing master is transferred; a developing unit having a plurality of developing rolls is used in a manner such that the percentage content of toner carried by the first developing roll is smaller than that carried by the remaining developing rolls, and the residual toner of the preceding printing cycle is removed mainly by the first developing roll, while developing with new toner is carried out by the remaining rolls.

DETAILED DESCRIPTION OF THE PREFERRED EMBODIMENTS

Figure 1:
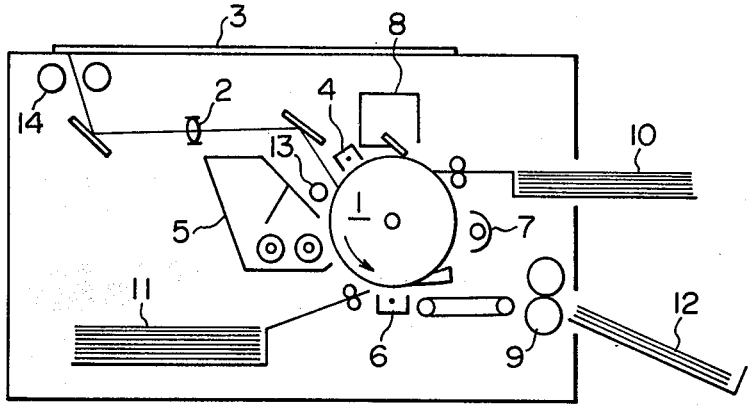
FIG. 1 is a sectional view outlining the construction of an electronic copying apparatus.
Figure 2:
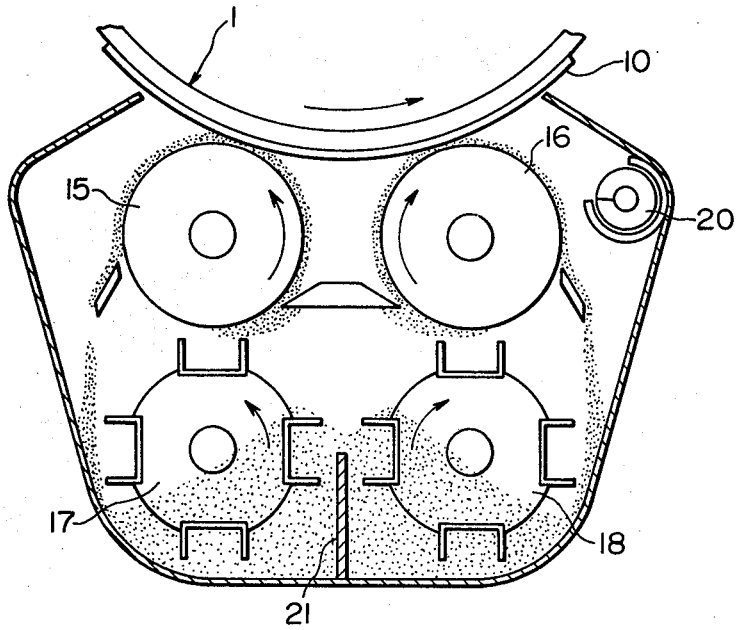
FIG. 2 is a sectional view outlining one example of a cleaning and developing unit according to this invention.

A cleaning and developing unit according to this invention will now be described with reference to FIG. 2 in detail.

A printing master, which has been prepared by fixing a toner image on a photo-conductive sheet (or a photo-sensitive sheet) 10 is supported on a rotary drum 1.

A residual toner image exists on the printing master which has undergone charging, overall exposure, developing and transferring in the first printing cycle. The residual toner image is charged by the transferring corotron and by the charging operation of the second revolution so as to have the same polarity as that of the electrostatic image on the printing master. As a result, the adhesion between the residual toner and the printing master is weakened.

In a developing operation in the second printing cycle, the percentage content of toner in the developing agent carried by the first roll 15 of several developing rolls on the entrance side (two developing rolls are employed in the case of FIG. 2) is made smaller than that of the other roll 16, so that the residual toner on the printing master, the adhesion of which was decreased, is removed by the first roll 15. At the same time, a small amount of new toner is stuck to the electrostatic image. The image is developed with the new toner by the developing roll 16 so that its density is correct. The image thus treated is transferred to a transfer sheet and is then fixed.

In order to make the percentage content $\alpha$ of a toner carried by the first developing roll 15 smaller than the percentage content $\beta$ of toner carried by the second developing roll, a toner supplying device 20 is provided only on the side of the second developing roll 16 according to the invention.

In order to maintain the amount of developing agent on the side of the first developing roll 15 and that on the side of the second developing roll 15 at constant levels, a barrier (to be described) for adjusting the amounts of developing agent is provided between the first developing roll 15 and second developing roll 16 sides of the developer according to the invention.

It is desirable that the developing agents are disposed in the developing unit after the percentage content $\alpha$ of toner in the developing agent on the first deveoping side and the percentage content $\beta$ of toner in the developing agent on the second developing side have been set to predetermined values. However, in the developing unit according to the invention, the developing efficiency of the first developing roll 15 is higher than that of the second developing roll 16, and therefore the toner content percentage $\alpha$ on the first developing roll side is decreased faster than that $\beta$ on the second developing roll side. Furthermore, as new toner is supplied only to the second developing roll side by the toner supplying device, the difference in toner content percentage can be set sufficiently quickly in any event.

Figure 3:
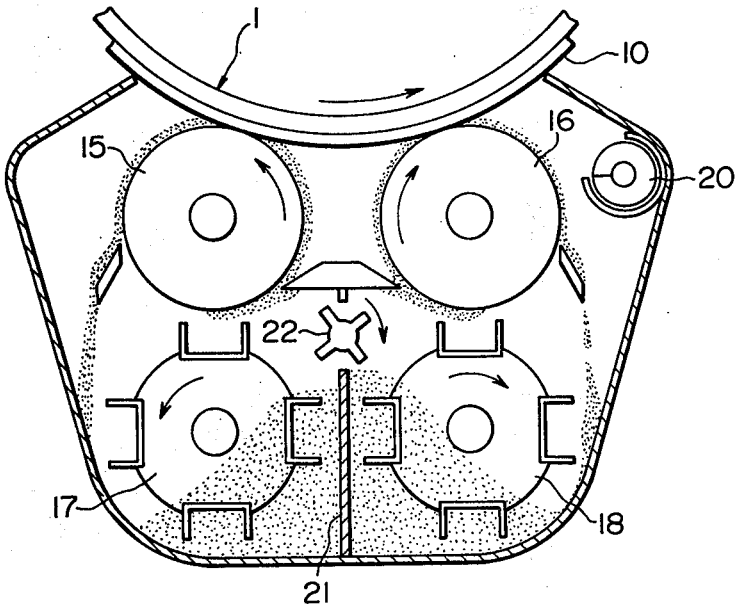
FIG. 3 is a sectional view outlining another example of the cleaning and developing unit according to the invention.

As the first developing roll 15 mainly removes the residual toner on the printing master, the toner content percentage $\alpha$ on the first developing roll side is scarcely decreased to an extremely low value. However, in the case where the amount of residual toner is extremely small, the toner content percentage $\alpha$ on the first developing roll side is decreased to an extremely low value, whereby the carrier in the developing agent is caused to stick to the photo-conductive sheet 10. The carrier thus stuck is recovered by the second developing roll 16, and therefore it will never be caused to flow out of the developing unit; however, the amount of developing agent on the first developing roll side is made smaller than a predetermined value. In order to eliminate this difficulty, a barrier 21 for adjusting the amounts of developing agent is provided between the first developing roll side and the second developing roll side, and especially between developing agent stirring members 17, 18 for the respective sides, so that any excessive amount of developing agent on the second developing roll side is caused to flow into the first developing roll side. The amount of developing agent which flows into the first developing roll side may be controlled by charging the height of the barrier 21. According to the invention, a suitable amount of developing agent on the second developing roll side, which is higher in toner content percentage, is caused to flow into the first developing roll side, as a result of which adhesion of the carrier to the photo-conductive sheet 10 can be prevented. If the developing agent is accumulated in more than a predetermined amount on the side of the second developing roll 16, the amount of developing agent can be adjusted by providing a developing agent conveying device 22 (FIG. 3) above the barrier 21, which is rotated to convey developing agent from the side of the second developing roll 16 to that of the first roll 15; that is, the amount of developing agent can be maintained stable.

As is apparent from the above description, in the cleaning and developing unit according to the invention, the amounts of developing agent are maintained stable on either side of an intermediate barrier, and the first developing roll is allowed to carry developing agent, the percentage content of toner in which is made lower than that in the developing agent carried by the other-developing roll. Therefore, the cleaning unit can be eliminated, and one copy can be obtained with only one revolution of the drum.

What is claimed is:

1. A cleaning and developing unit, comprising:

a plurality of developing rolls, comprising a first developing roll provided on an entrance side of said unit for cleaning and developing an image on a sheet with a toner, and remaining developing rolls disposed on a second side for developing said image with said toner on said sheet;

a toner supplying device for supplying said toner to only said second side; and a barrier for adjusting amounts of developing agent allowed to migrate from said second side to said entrance side, said barrier being provided between said entrance side and said second side in such a manner as to at least partially separate said two sides from each other.

2. A cleaning and developing unit, comprising:

a plurality of developing rolls including a first developing roll provided on an entrance side of a member to be developed for cleaning and developing an image on said member with a toner, and remaining developing rolls for developing said image with said toner on said member;

a toner supplying device for supplying said toner to a side containing said remaining developing rolls;

a barrier for adjusting amounts of developing agent travelling between said side containing said remaining developing rolls and said entrance side, said barrier being provided between said two sides in manner such as to separate the two sides from each other; and a device for conveying developing agent to the entrance side.

3. A cleaning and developing unit as claimed in claims 1 or 2, said barrier comprising toner regulating means for said entrance side, a percentage content of toner in the developing agent in said entrance side being maintained substantially lower than that in the developing agent in the other of the two sides.

4. A cleaning and developing unit as claimed in claims 1 or 2, said barrier being provided on a bottom wall of said developing unit, and having a height selected to provide a desired amount of developing agent migration between the two sides.

5. A cleaning and developing unit as claimed in claim 2, said developing agent conveyor being disposed just above said barrier.

6. A cleaning and developing unit as claimed in claim 2, said toner supplying device supplying toner to only said side containing the remaining developing rolls.

7. A cleaning and developing unit as claimed in claims 1 or 2, a level of said developing agent in said unit being maintained, in a region proximate said barrier, at a position slightly above a top of said barrier.

8. A cleaning and developing unit as claimed in claims 1 or 2, said barrier comprising toner regulating means for said entrance side, a percentage content of toner in the developing agent in said two sides being such that said content is substantially lower in said entrance side, whereby said first developing roll functions primarily as a cleaning roll.

* * * * *